US010455935B1

(12) United States Patent
Chen

(10) Patent No.: US 10,455,935 B1
(45) Date of Patent: Oct. 29, 2019

(54) POST AND DECK COMBINATION FOR A SHELF ASSEMBLY

(71) Applicant: Affinity Hardware Co., Ltd., Taipei (TW)

(72) Inventor: Chien-Fu Chen, Taipei (TW)

(73) Assignee: Affinity Hardware Co., Ltd., Taipei (TW)

( * ) Notice: Subject to any disclaimer, the term of this patent is extended or adjusted under 35 U.S.C. 154(b) by 0 days.

(21) Appl. No.: 16/131,109

(22) Filed: Sep. 14, 2018

(51) Int. Cl.

| | |
|---|---|
| ***A47B 57/14*** | (2006.01) |
| ***A47B 57/22*** | (2006.01) |
| ***A47B 47/02*** | (2006.01) |
| *A47B 51/00* | (2006.01) |
| *A47B 55/00* | (2006.01) |

(52) U.S. Cl.
CPC ..... *A47B 57/14* (2013.01); *A47B 47/027* (2013.01); *A47B 57/22* (2013.01); *A47B 51/00* (2013.01); *A47B 55/00* (2013.01)

(58) Field of Classification Search
CPC ..... A47B 57/14; A47B 57/22; A47B 47/027; A47B 51/00; A47B 55/00
See application file for complete search history.

(56) References Cited

U.S. PATENT DOCUMENTS 2,639,043 A * 5/1953 Dunham ..... A47B 57/50 108/64
2,733,037 A * 1/1956 Dunham ..... A47B 57/50 248/222.41
2,990,067 A * 6/1961 Bartlett ..... A47B 57/20 108/147.15
3,280,767 A * 10/1966 Kahn ..... A47B 57/26 108/147.13
3,294,250 A * 12/1966 Evans ..... A47B 57/22 108/147.15
3,367,291 A * 2/1968 Evans ..... A47B 47/03 108/106
3,874,511 A * 4/1975 Maslow ..... A47B 57/265 211/153
4,257,333 A * 3/1981 Pollack ..... A47B 57/265 108/147.13
4,582,001 A * 4/1986 Leikarts ..... A47B 57/265 108/106

(Continued)

FOREIGN PATENT DOCUMENTS

DE 29921735 U1 * 4/2000 ..... A47B 57/22

*Primary Examiner* — Stanton L Krycinski
(74) *Attorney, Agent, or Firm* — Alan D. Kamrath; Karin L. Williams; Mayer & Williams PC

(57) ABSTRACT

A post and deck combination for a shelf assembly includes a hollow vertical post having an outer wall with slots at different heights. Each slot has a positioning portion. A coupling board is disposed on an edge of a deck and includes a first insertion groove. A coupling member includes a columnar portion interconnected between first and second ends thereof and having a first section with a diameter smaller than a width of each positioning portion and a second section received in the first insertion groove. The coupling member extends through one of the slots. The positioning portion of the one of the slots is located at the first section. The first insertion groove is coupled with the first end of the coupling member. A first receiving end of the first insertion groove is located on an inclined guiding face of the second section.

18 Claims, 15 Drawing Sheets

(56) References Cited

U.S. PATENT DOCUMENTS 5,350,073 A * 9/1994 Thornley ..... A47B 57/22 108/107
5,441,162 A * 8/1995 Niblock ..... A47B 55/02 211/153
5,957,060 A * 9/1999 Rosenband ..... A47B 57/22 108/107
6,044,988 A * 4/2000 Yang ..... A47B 57/265 108/107
6,253,933 B1 * 7/2001 Yang ..... A47B 57/545 108/147.12
6,364,138 B1 * 4/2002 Chen ..... A47B 57/26 108/147.13
7,191,908 B2 * 3/2007 De Rijk ..... A47B 57/32 211/187
7,478,971 B2 * 1/2009 Li ..... A47B 57/545 108/147.13
7,543,540 B2 * 6/2009 Tatematsu ..... A47B 47/047 108/192
8,016,140 B2 * 9/2011 Hsieh ..... A47B 47/0083 211/187
8,118,181 B2 * 2/2012 Shinozaki ..... A47B 47/0083 108/147.13
8,286,564 B2 * 10/2012 Karl ..... A47B 57/545 108/107
8,672,150 B2 * 3/2014 Chen ..... A47B 57/50 108/147.16
9,380,868 B1 * 7/2016 Fu ..... A47B 57/34
9,930,961 B2 * 4/2018 Kessell ..... A47B 57/26
10,058,174 B1 * 8/2018 Tang ..... A47B 57/545
2007/0034584 A1 * 2/2007 Park ..... A47B 57/265 211/187
2010/0108631 A1 * 5/2010 McAllister ..... A47B 57/545 211/187
2015/0289644 A1 * 10/2015 Sabounjian ..... A47B 57/545 211/187
2015/0313357 A1 * 11/2015 David ..... A47B 47/0083 211/187
2017/0347793 A1 * 12/2017 Wang ..... A47B 47/025

* cited by examiner

POST AND DECK COMBINATION FOR A SHELF ASSEMBLY

BACKGROUND OF THE INVENTION

The present invention relates to a post and deck combination for a shelf assembly and, more particularly, to a shelf assembly providing enhanced assembling stability and convenient assemblage.

A type of shelf assembly includes a plurality of vertical posts and a plurality of support boards parallel to the ground. FIG. 13 shows a portion of a conventional shelf assembly, with the portion including a plurality vertical posts 1', a plurality of horizontal beams 2', and a support board 3'. Each of the vertical posts 1' and the horizontal beams 2' includes a plurality of engaging holes 11', 21'. Bolts 4' extend through engaging holes 11' and 21' in proper locations and are coupled with nuts 41' to assemble the vertical posts 1' and the horizontal beams 2' together. The support board 3' is placed on the vertical beams 1' and the horizontal beams 2' for supporting articles.

However, the assemblage requires extending the bolts 4' through the engaging holes 11' and 21' and coupling the bolts 4' with the nuts 41', resulting in inconvenient assemblage. Furthermore, the shelf assembly is apt to fall when the threading connection between the bolts 4' and the nuts 41' is not secure. Furthermore, the support board 3' rests on the vertical beams 1' and the horizontal beams 2' by its weight and is not securely positioned. Thus, the support board 3' is apt to displace and fall due to impact.

FIGS. 14 and 15 show another conventional shelf assembly including four vertical posts 5', a plurality of clamping sleeves 6', and a plurality of decks 7'. Each vertical post 5' is placed upright from the ground and includes a plurality of engaging grooves 51' at different heights. Each clamping sleeve 6' includes a conical surface and is configured to clamp a respective vertical post 5'. Each clamping sleeve 6' includes a protrusion 61' for coupling with a respective engaging groove 51' and is, thus, positioned at the proper height. Each deck 7 includes a disposition portion 71' parallel to the ground. The disposition portion 71' includes coupling portions 72' each having a conic hole 73' for securely coupling with a respective clamping sleeve 6'.

Although the above shelf assembly can be easily assembled without bolts and nuts, the lowest deck 7' at the bottommost layer A can only be retrieved after the upper decks 7' are removed, which is inconvenient to replacement. Furthermore, when it is desired to expand the shelf assembly, a height difference exists between the deck 7' at height B and the deck 7' at height C, leading to a poor assembling integrity and inconvenience to placement of objects.

Furthermore, the clamping sleeves 6' could become brittle after a period of time of use. The decks 7' will fall when the clamping sleeves 6' break.

BRIEF SUMMARY OF THE INVENTION

An objective of the present invention is to provide a post and deck combination for a shelf assembly providing enhanced assembling stability and assembling convenience.

In an aspect, a post and deck combination for a shelf assembly according to the present invention includes a vertical post which is hollow and which includes an outer wall. A plurality of slots is disposed at different heights of the outer wall. Each of the plurality of slots has a positioning portion. A deck is disposed parallel to the ground. A coupling board is disposed on an edge of the deck and includes a first insertion groove having a first receiving end. A coupling member is columnar and includes a first end, a second end, and a columnar portion interconnected between the first end and the second end. The columnar portion includes a first section adjacent to the first end and a second section adjacent to the second end. A diameter of the first section is smaller than a width of each positioning portion of the vertical post. The second section is interconnected to the first section and has a diameter to be received in the first receiving end of the first insertion groove. The columnar portion has decreasing diameters from the second end toward the first section. The second section includes an inclined guiding face. The coupling member is configured to extend through one of the plurality of slots to couple with the vertical post. The positioning portion of the one of the plurality of slots is located at the first section of the coupling member. The first insertion groove of the coupling board is coupled with the first end of the coupling member. The first receiving end is located on the inclined guiding face of the second section. The coupling board is movable toward the first section.

In an example, each of the plurality of slots includes an insertion portion at an upper end thereof. The positioning portion is located below the insertion portion. The width of the positioning portion is smaller than a width of the insertion portion. The first end of the coupling member includes a first stopper face extending radially outward from the columnar portion. A diameter of the first end of the coupling member is smaller than the width of each insertion portion and is larger than the width of each positioning portion. The second end of the coupling member includes a second stopper face extending radially outward from the columnar portion. A diameter of the second end of the coupling member is larger than a width of the first receiving end of the coupling board. A spacing between the first stopper face and the second stopper face is larger than a sum of a thickness of the outer wall of the vertical post and a thickness of the coupling board of the deck after assembly.

In an example, a lining board made of a material softer than the vertical post and the coupling board is provided. The lining board includes a second insertion groove having a second receiving end. The lining board is configured to couple with the coupling member by the second insertion groove. The second receiving end is located at the first section of the coupling member. The lining board is disposed between the outer wall of the vertical post and the coupling board of the deck.

In an example, the vertical post has square cross sections. The outer wall includes a first side having the plurality of slots. The outer wall further includes second and third sides opposite to each other and extending perpendicularly to the first side. The lining board includes a fourth side, a fifth side, and a sixth side respectively abutting against the first side, the second side, and the third side of the vertical post. The second insertion groove is disposed on the fourth side. The coupling board of the deck includes a seventh side, an eighth side, and a ninth side respectively abutting against the fourth side, the fifth side, and the sixth side. The first insertion groove is disposed in the seventh side.

In an example, the plurality of slots is disposed in two sides of the vertical post spaced from each other by 180° and are located at corresponding heights.

In an example, the first insertion groove of the deck extends upward from a bottom of the coupling board. The first insertion groove includes a first opening at a lower end thereof and the first receiving end in a top end thereof. A width of the first opening is larger than a width of the first receiving end.

In an example, the second insertion groove extends upward from a bottom of the lining board. The second insertion groove includes a second opening at a lower end thereof and the second receiving end in a top end thereof. A width of the second opening is larger than a width of the second receiving end.

In an example, the lining board includes an inner side having an inclined coupling face inclining outwardly and downwardly from a top end of the inner side toward a bottom end of the inner side of the lining board.

In an example, the lining board includes a protrusion located above the second insertion groove, and the protrusion is configured to be inserted into one of the plurality of slots of the vertical post and to engage with a peripheral edge of the one of the plurality of slots.

In another aspect, a shelf assembly includes four vertical posts disposed in four corners of a rectangular area. Each of the four vertical posts is hollow and includes an outer wall having a plurality of engaging slots disposed at different heights of the outer wall. Each of the plurality of slots has a positioning portion. A plurality of decks is disposed parallel to the ground. Each of the plurality of decks includes four corners. Each of the four corners of each of the plurality of decks includes a coupling board. Each coupling board includes a first insertion groove having a first receiving end. A plurality of coupling members is provided. Each of the plurality of coupling members is columnar and includes a first end, a second end, and a columnar portion interconnected between the first end and the second end. The columnar portion includes a first section adjacent to the first end and a second section adjacent to the second end and interconnected to the first section. A diameter of the first section is smaller than a width of each positioning portion. The columnar portion has decreasing diameters from the second end toward the first section. The second section includes an inclined guiding face. The second section of each of the plurality of coupling members has a diameter to be received in the first receiving end of the first insertion groove of a respective coupling board. The first end of each of the plurality of coupling members is configured to extend through one of the plurality of slots of a respective one of the four vertical posts to couple with the respective one of the four vertical posts. The positioning portion of the one of the plurality of slots is located at the first section of the coupling member. The first insertion groove of each coupling board is coupled with a respective one of the plurality of coupling members. The first receiving end of each coupling board is located on the inclined guiding face of the second section of the respective one of the plurality of coupling members. Each coupling board is movable toward the first section of the respective one of the plurality of coupling members.

In an example, each of the plurality of slots includes an insertion portion at an upper end thereof. The positioning portion is located below the insertion portion. The width of the positioning portion is smaller than a width of the insertion portion. The first end of each of the plurality of coupling members includes a first stopper face extending radially outward from the columnar portion. A diameter of the first end of each of the plurality of coupling members is smaller than the width of each insertion portion and is larger than the width of each positioning portion. The second end of each of the plurality of coupling members includes a second stopper face extending radially outward from the columnar portion. A diameter of the second end of each of the plurality of coupling members is larger than a width of the first receiving end of each four coupling board. A spacing between the first stopper face and the second stopper face of each of the plurality of coupling members is larger than a sum of a thickness of the outer wall of the respective one of the four vertical posts and a thickness of the respective coupling board after assembly.

In an example, a plurality of lining boards made of a material softer than the four vertical posts and the coupling boards is provided. Each of the plurality of lining boards includes a second insertion groove having a second receiving end. Each of the plurality of lining boards is configured to couple with the respective one of the plurality of coupling members by the second insertion groove. The second receiving end is located at the first section of the respective one of the plurality of coupling members. Each of the plurality of lining boards is disposed between the outer wall of the respective one of the four vertical posts and a respective coupling board.

In an example, each of the four vertical posts has square cross sections. The outer wall of each of the four vertical posts includes a first side having the plurality of slots. The outer wall of each of the four vertical posts further includes second and third sides opposite to each other and extending perpendicularly to the first side. Each of the plurality of lining boards includes a fourth side, a fifth side, and a sixth side respectively abutting against the first side, the second side, and the third side of the respective one of the four vertical posts. The second insertion groove is disposed on the fourth side. Each coupling board includes a seventh side, an eighth side, and a ninth side respectively abutting against the fourth side, the fifth side, and the sixth side of a respective one of the plurality of lining boards. The first insertion groove is disposed in the seventh side.

In an example, the plurality of slots of each of the four vertical posts is disposed in two sides of the vertical post spaced from each other by 180° and is located at corresponding heights.

In an example, each first insertion groove extends upward from a bottom of the respective coupling board. Each first insertion groove includes a first opening at a lower end thereof and the first receiving end in a top end thereof. A width of the first opening is larger than a width of the first receiving end.

In an example, each second insertion groove extends upward from a bottom of a respective one of the plurality of lining boards. The second insertion groove includes a second opening at a lower end thereof and the second receiving end in a top end thereof. A width of the second opening is larger than a width of the second receiving end.

In an example, each of the plurality of lining boards includes an inner side having an inclined coupling face inclining outwardly and downwardly from a top end of the inner side toward a bottom end of the inner side of the lining board.

In an example, each of the plurality of lining boards includes a protrusion located above the second insertion groove, and the protrusion is configured to be inserted into one of the plurality of slots of the respective one of the four vertical posts and to engage with a peripheral edge of the one of the plurality of slots.

The present invention will become clearer in light of the following detailed description of illustrative embodiments of this invention described in connection with the drawings.

DETAILED DESCRIPTION OF THE INVENTION

Figure 1:
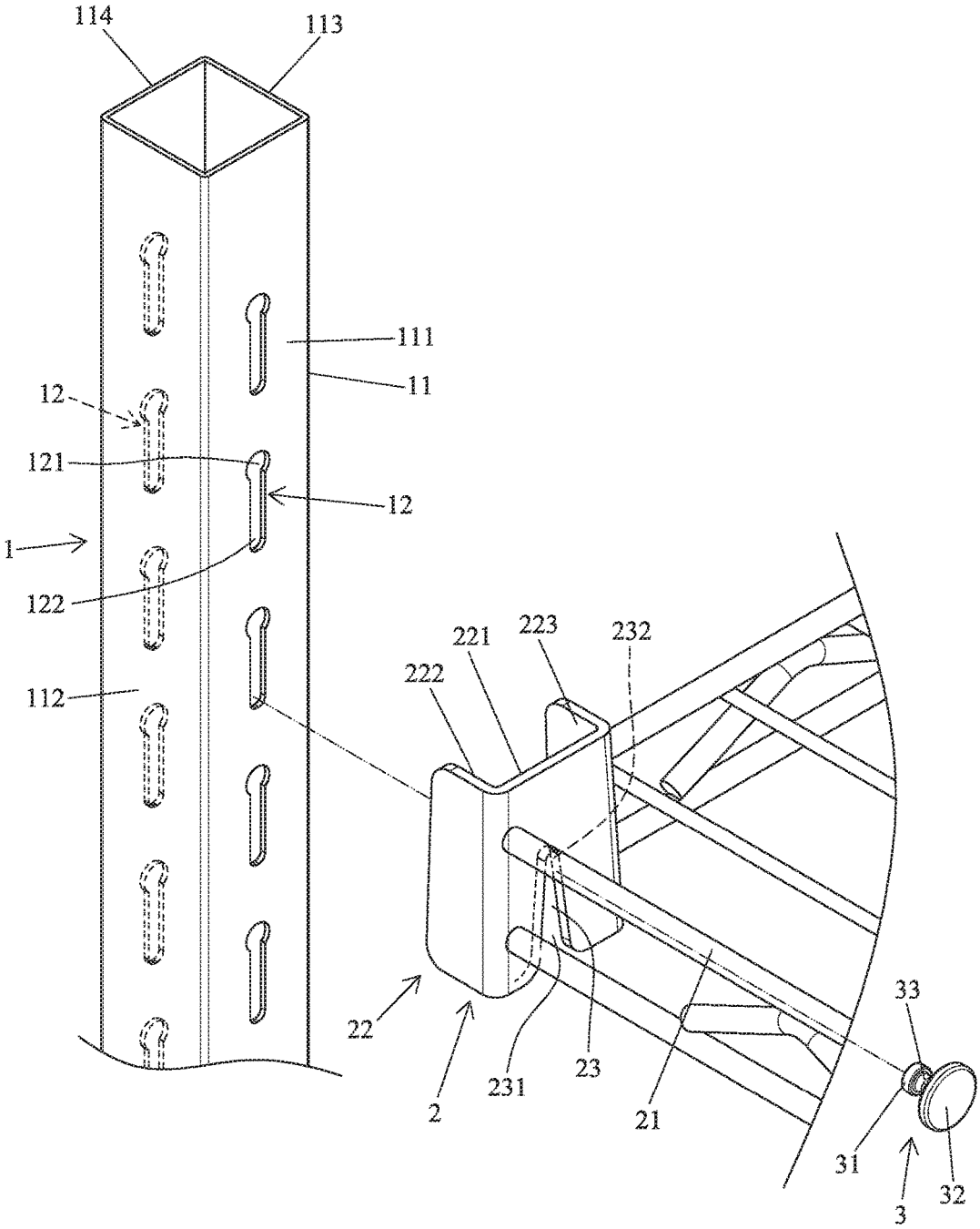
FIG. 1 is a partial, exploded, perspective view of a post and deck combination for a shelf assembly of a first example according to the present invention.

Where used in the various figures of the drawings, the same numerals designate the same or similar parts. With reference to FIGS. 1-4, a post and deck combination for a shelf assembly of a first example according to the present invention includes a vertical post 1, a deck 2, and a coupling member 3. A side adjacent to a center of the deck 2 is an inner side, and a side remote to the center of the deck 2 is an outer side. The vertical post 1 is hollow and is made of metal or other rigid material. In this example, the vertical post 1 has square cross sections and includes an outer wall 11 having a first side 111, second and third sides 112, 113 opposite to each other and extending perpendicularly to the first side 111, and a tenth side 114 spaced from the first side 111 by 180°. A plurality of slots 12 is disposed at different heights of the first side 111 of the outer wall 11. Each of the plurality of slots 12 has an insertion portion 121 at an upper end thereof and a positioning portion 122 below the insertion portion 212. The positioning portion 122 has a width smaller than a width of the insertion portion 121. The tenth side 114 includes a plurality of slots 12 located at corresponding heights of the plurality of slots 12 on the first side 111.

The deck 2 is disposed parallel to the ground and includes a supporting portion 21. A coupling board 22 is disposed on an edge of the deck 2. The coupling board 22 of the deck 2 includes a seventh side 221, an eighth side 222, and a ninth side 223 corresponding to the first side 111, the second side 112, and the third side 113. A first insertion groove 23 is disposed in the seventh side 221 and extends upward from a bottom of the coupling board 22. The first insertion groove 23 includes a first opening 231 at a lower end thereof and a first receiving end 232 in a top end thereof. A width of the first opening 231 is larger than a width of the first receiving end 232. The deck 2 can include a plurality of coupling boards 2.

The coupling member 3 is made of metal or other rigid material. The coupling member 3 is columnar and includes a first end 31, a second end 32, and a columnar portion 33 interconnected between the first end 31 and the second end 32. The first end 31 can be coupled with a selected one of the plurality of slots 12 of the vertical post 1. The first end 31 of the coupling member 3 includes a first stopper face 311 extending radially outward from the columnar portion 33. A diameter of the first end 31 of the coupling member 3 is smaller than the width of each insertion portion 121 and is larger than the width of each positioning portion 122. The second end 32 of the coupling member 3 includes a second stopper face 321 extending radially outward from the columnar portion 33. A diameter of the second end 32 of the coupling member 3 is larger than a width of the first receiving end 232 of the coupling board 22.

The columnar portion 33 includes a first section 331 adjacent to the first end 31 and a second section 332 adjacent to the second end 32. The first section 331 is cylindrical and has a diameter smaller than a width of each positioning portion 122. The second section 332 is interconnected to the first section 331 and has a diameter to be received in the first receiving end 232 of the first insertion groove 23. The columnar portion 33 has decreasing diameters from the second end 32 toward the first section 331. The second section 332 includes an inclined guiding face 333. TA spacing between the first stopper face 311 and the second stopper face 321 is larger than a sum of a thickness of the outer wall 11 of the vertical post 1 and a thickness of the coupling board 22 of the deck 2 after assembly.

Figure 2:
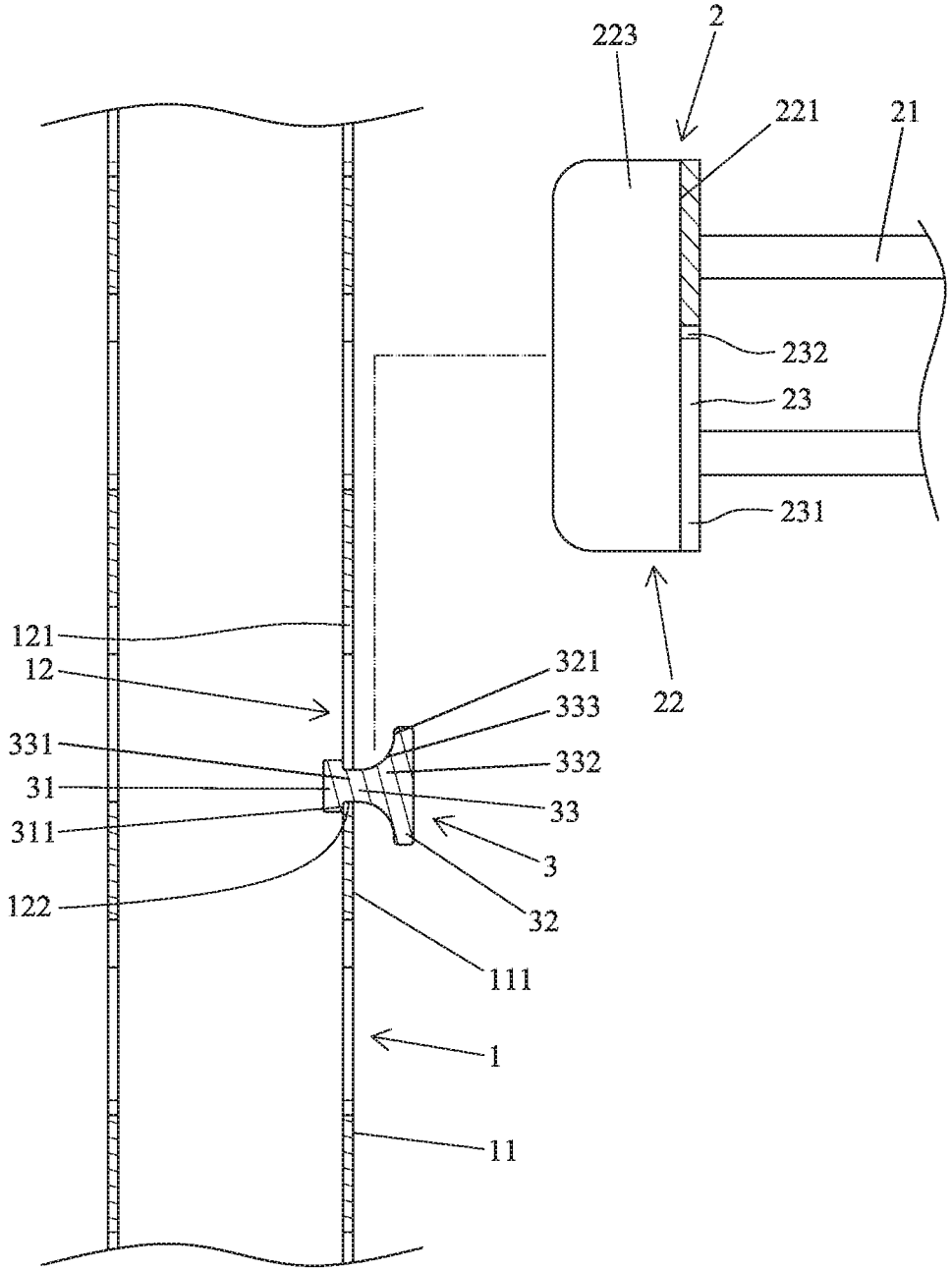
FIG. 2 is a partial, cross sectional view showing assemblage of the combination of the first example of FIG. 1.

In assembly, as shown in FIG. 2, the first end 31 of the coupling member 3 extends through one of the plurality of slots 12 at a desired height. The first end 31 is firstly inserted through the insertion portion 121 and is then moved downward to the positioning portion 122. Since the diameter of the first end 31 is larger than the width of the positioning portion 122, the first stopper face 311 abuts against an inner face of the outer wall 11 of the vertical post 1 without the risk of falling. Furthermore, the positioning portion 122 is located at the first section 331 of the coupling member 3.

Figure 3:
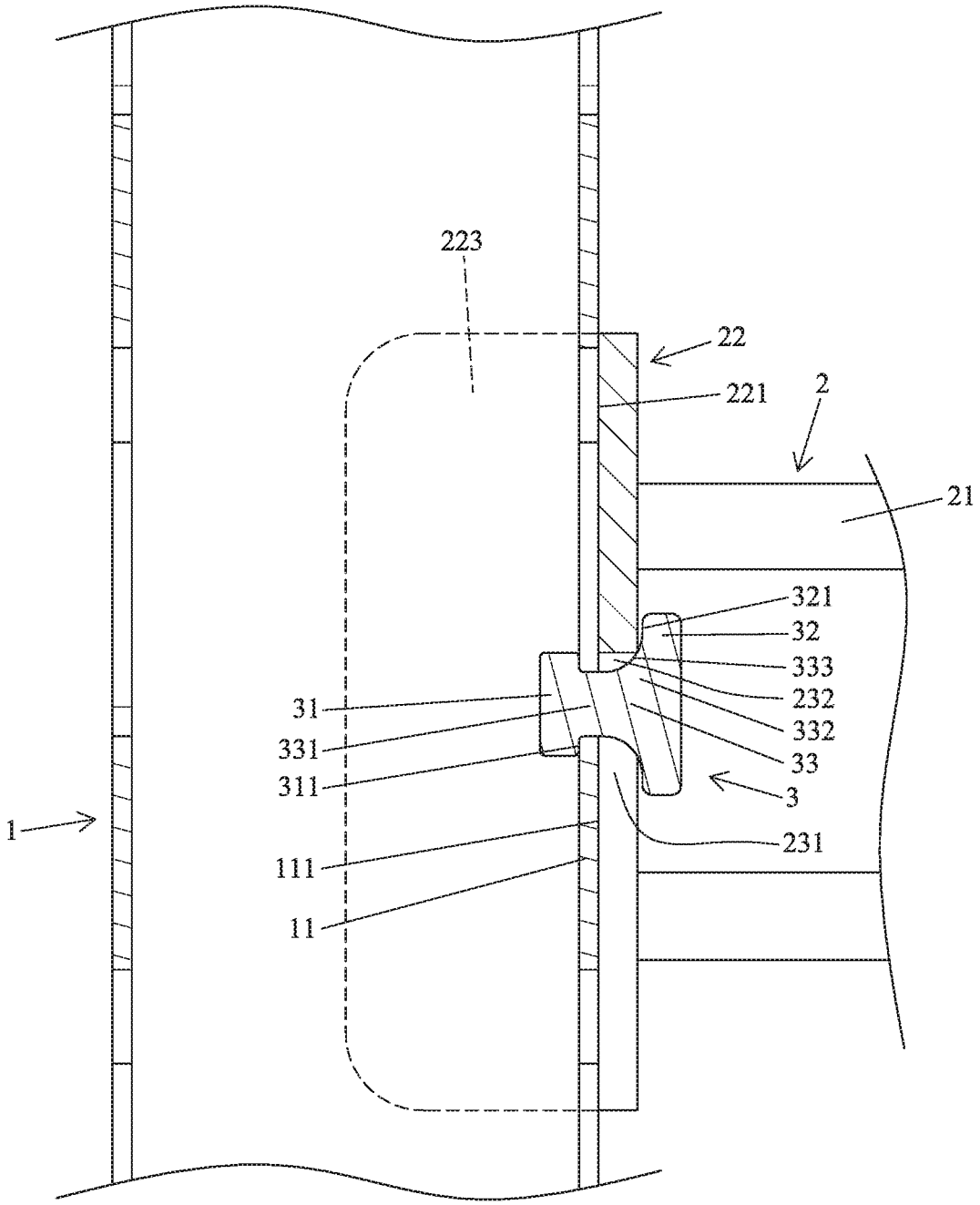
FIG. 3 is a partial, cross sectional view similar to FIG. 2, illustrating the combination after assembly.
Figure 4:
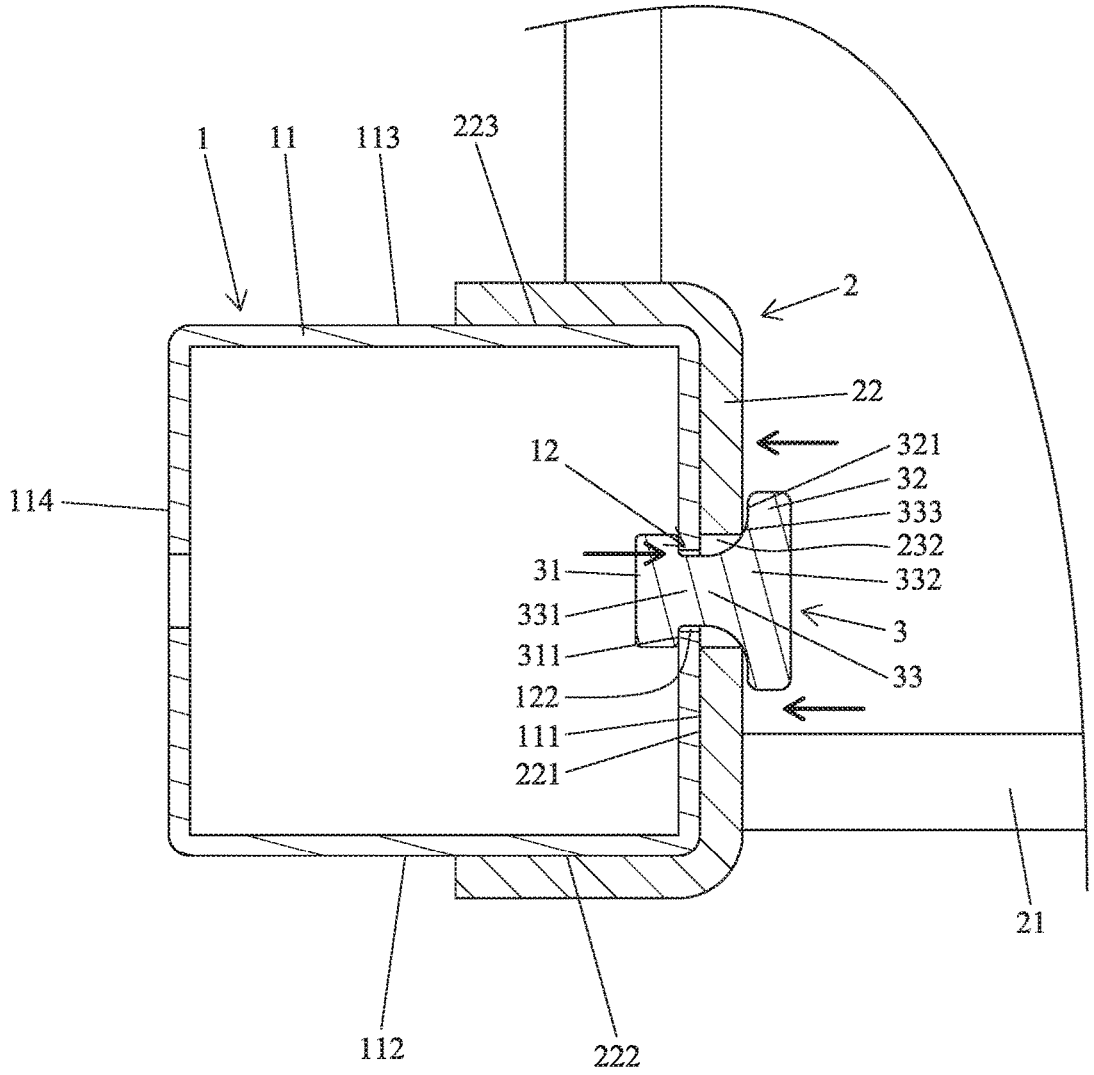
FIG. 4 is a partial, top, cross sectional view of the combination of FIG. 1 after assembly.

With reference to FIGS. 3 and 4, the coupling board 22 of the deck 2 is coupled with the vertical post 1. The first insertion groove 23 of the coupling board 22 is coupled with the second section 332 of the coupling member 3. The first receiving end 232 abuts against the inclined guiding face 333 of the second portion 332. The seventh side 221, the eighth side 222, and the third side 223 of the coupling board 22 abut against the first side 111, the second side 112, and the third side 113 of the vertical post 1, respectively. Articles (not shown) can be placed on the deck 2. The weight of the deck 2 and the articles urge the coupling board 22 to slide outward along the inclined guiding face 333 to thereby tightly press against the vertical post 1, providing enhanced assembling stability.

Figure 5:
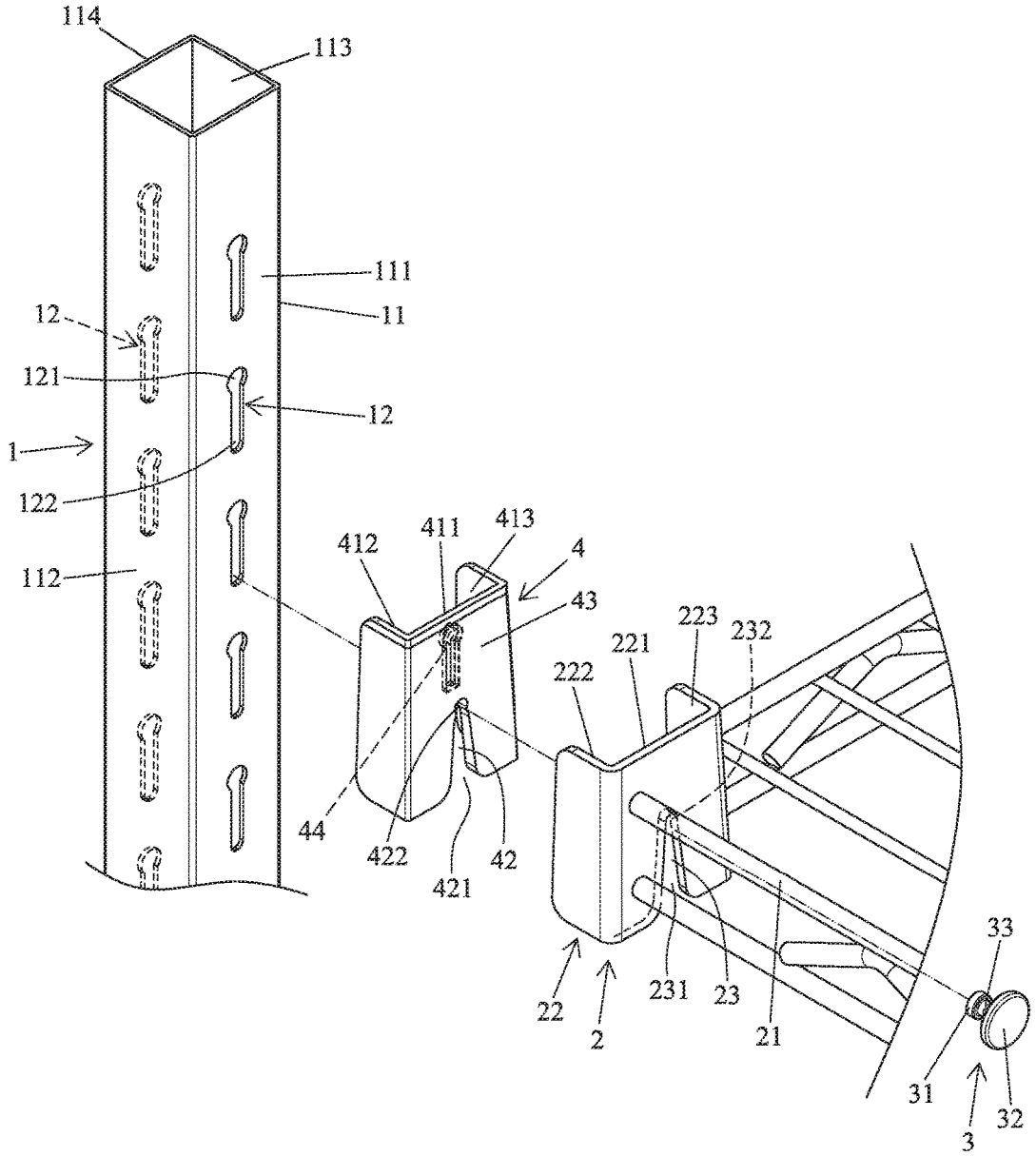
FIG. 5 is a partial, exploded, perspective view of a post and deck combination for a shelf assembly of a second example according to the present invention.
Figure 6:
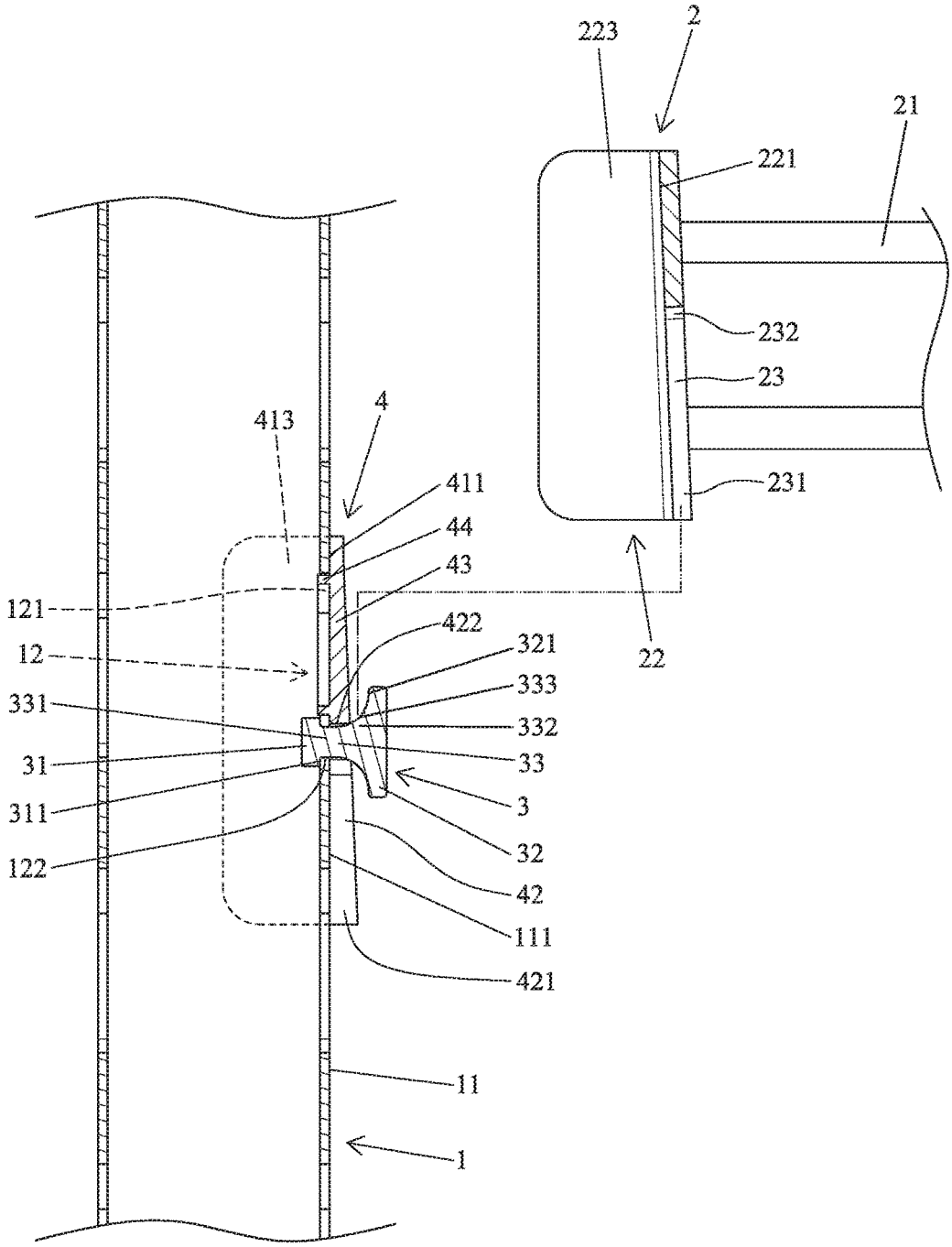
FIG. 6 is a partial, cross sectional view showing assemblage of the combination of the second example of FIG. 5.
Figure 7:
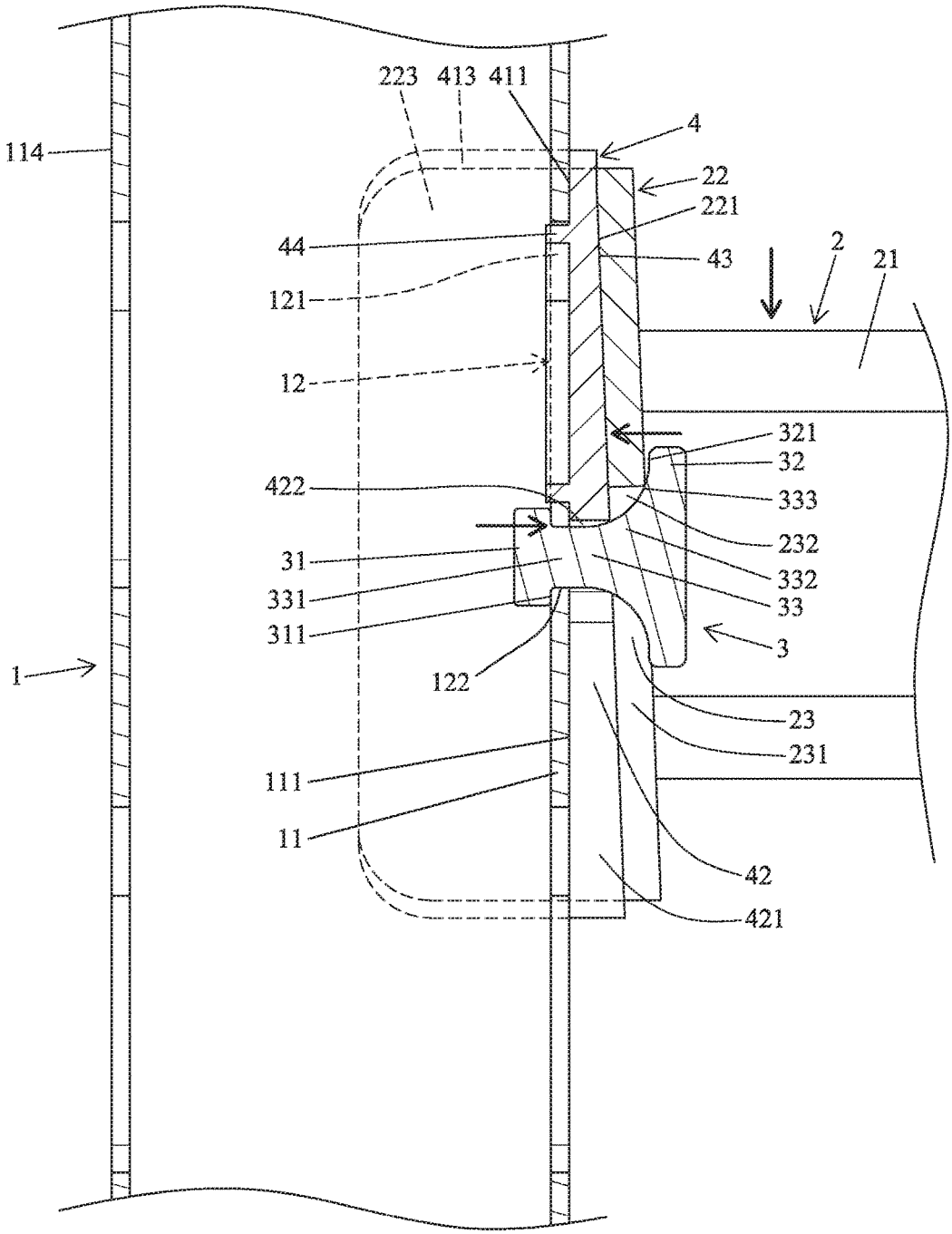
FIG. 7 is a partial, cross sectional view similar to FIG. 6, illustrating the combination after assembly.

FIGS. 5-7 show a post and deck combination for a shelf assembly of a second example according to the present invention, which is different from the first example by an additional lining board 4. Furthermore, the seventh side 221 of the coupling board 22 is inclined. Furthermore, the spacing between the first stopper face 311 and the second stopper face 321 of the coupling member 3 is larger than the sum of the thickness of the outer wall 11, the thickness of the lining board 4, and the thickness of the coupling board 22 after assembly. The lining board 4 can be made of plastic or a material softer than the vertical post 1 and the coupling board 2. The lining board 4 is mounted between the outer wall 11 and the coupling board 2 and can be mounted around the outer wall 11.

The lining board 4 includes a fourth side 411, a fifth side 412, and a sixth side 413 respectively coupled with the first side 111, the second side 112, and the third side 113 of the vertical post 1. The seventh side 221, the eighth side 222, and the ninth side 223 of the coupling board 22 respectively abut against the fourth side 411, the fifth side 412, and the sixth side 413. A second insertion groove 42 is disposed on the fourth side 411 and extends upward from a bottom of the lining board 4. The second insertion groove 42 includes a second opening 421 at a lower end thereof and a second receiving end 422 in a top end thereof. A width of the second opening 421 is larger than a width of the second receiving end 422. The lining board 4 further includes an inner side having an inclined coupling face 43 inclining outwardly and downwardly from a top end of the inner side toward a bottom end of the inner side of the lining board 4. The inclined coupling face 43 abuts against the seventh side 221 of the coupling board 22. Furthermore, the lining board 4 includes a protrusion 44 located above the second insertion groove 42. The protrusion 44 is configured to be inserted into one of the plurality of slots 12 of the vertical post 1 and to engage with a peripheral edge of the one of the plurality of slots 12.

In assembly of the second example, the first end 31 of the coupling member 3 extends through one of the plurality of slots 12 at a desired height. The first end 31 is firstly inserted through the insertion portion 121 and is then moved downward to the positioning portion 122. Then, as shown in FIG. 6, the second insertion groove 42 of the lining board 4 is coupled with the first section 331 of the coupling member 3, and the second receiving end 422 abuts against the first section 331 of the coupling member 3. Furthermore, the protrusion 44 of the lining board 4 is engaged in the upper end of the one of the plurality of slots 12. Furthermore, the fourth side 411, the fifth side 412, and the sixth side 413 of the lining board 4 respectively abut against the first side 111, the second side 112, and the third side 113 to provide enhanced coupling stability while preventing the lining board 4 from twisting relative to the vertical post 1.

With reference to FIG. 7, the coupling board 22 of the deck 2 is coupled with the lining board 4. The first insertion groove 23 of the coupling board 22 is coupled with the second section 332 of the coupling member 3. The first receiving end 232 abuts against the inclined guiding face 333 of the second portion 332. The seventh side 221, the eighth side 222, and the ninth side 223 of the coupling board 22 abut against the fourth side 411, the fifth side 412, and the sixth side 413 of the lining board 4, respectively. Articles (not shown) can be placed on the deck 2. The weight of the deck 2 and the articles urge the coupling board 22 to slide outward along the inclined guiding face 333 to thereby tightly press against the limiting board 4, providing enhanced assembling stability while providing a tight contact between the vertical post 1 and the lining board 4. Since the lining board 4 is made of a material softer than the vertical post 1 and the coupling board 22 and since the inclined coupling face 43 abuts against the inclined seventh side 221 to enhance the coupling stability therebetween, the overall assembly will not become loose to provide enhanced, tightened, assembling stability.

Figure 8:
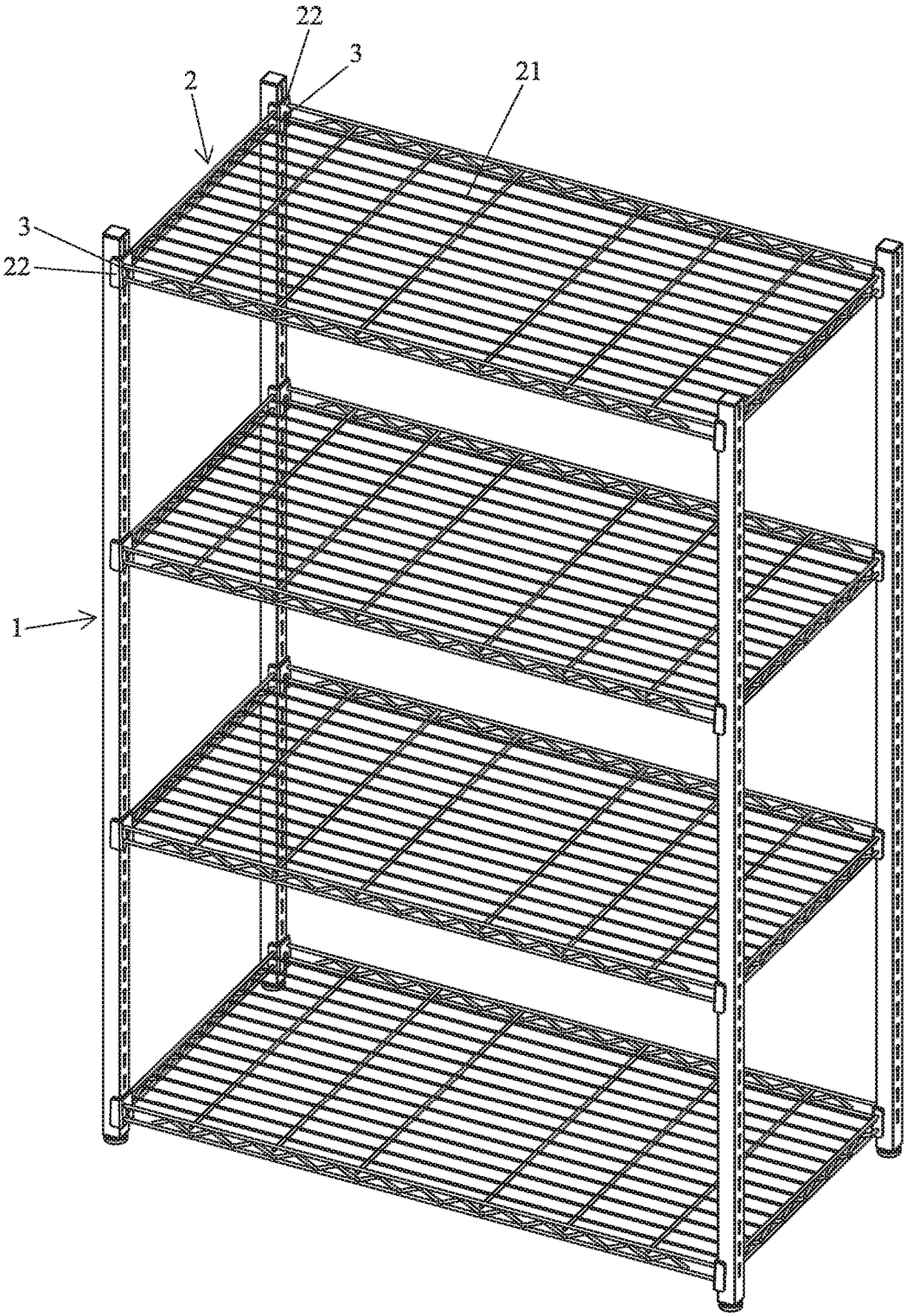
FIG. 8 is a perspective view of a shelf assembly constructed by the combination of the second example according to the present invention.

With reference to FIG. 8, a shelf assembly can be assembled from a plurality of vertical posts 1, a plurality of decks 2, and a plurality of fasteners 3 according to the present invention. In this example, four vertical posts 1 are located in four corners of a rectangular area. Each deck 2 is rectangular and includes four coupling boards 22 at four corners thereof. Lining boards 4 can be mounted as desired.

Figure 9:
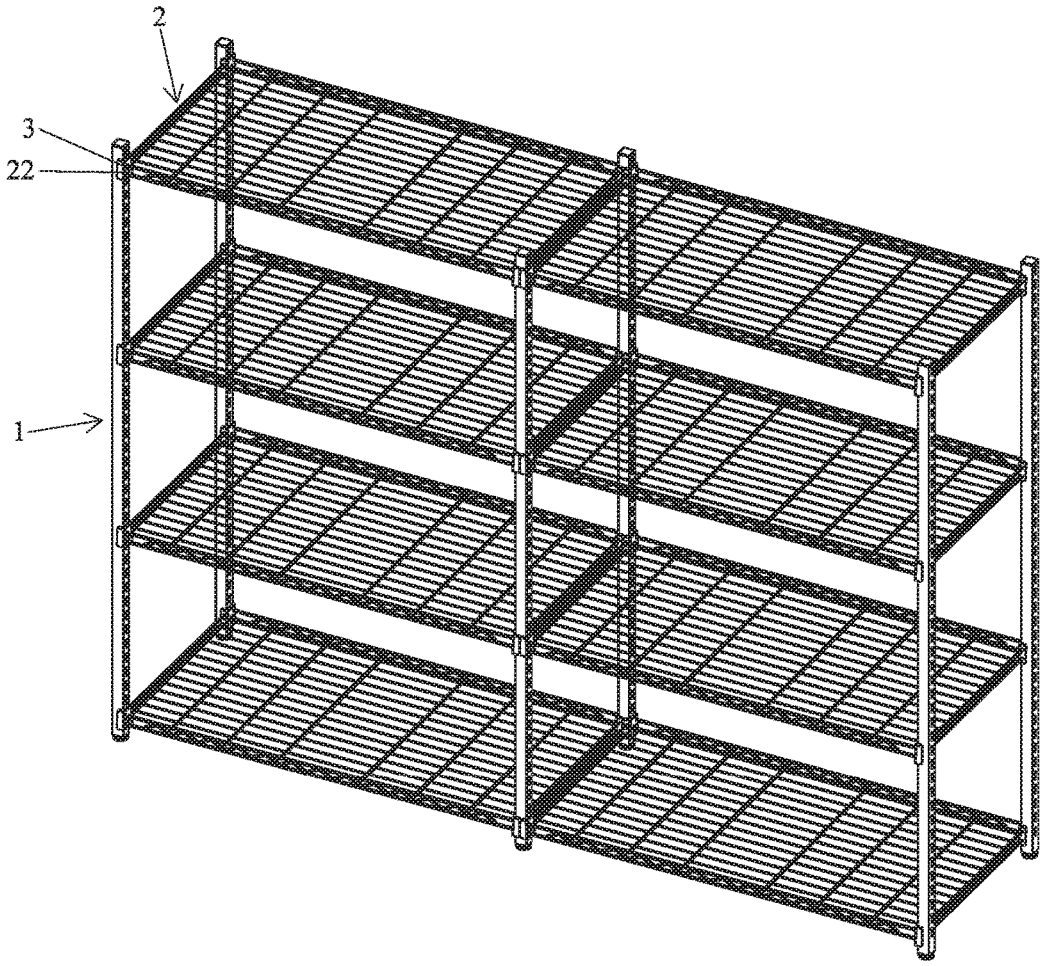
FIG. 9 is a perspective view of another shelf assembly constructed by the combination of the second example according to the present invention.
Figure 10:
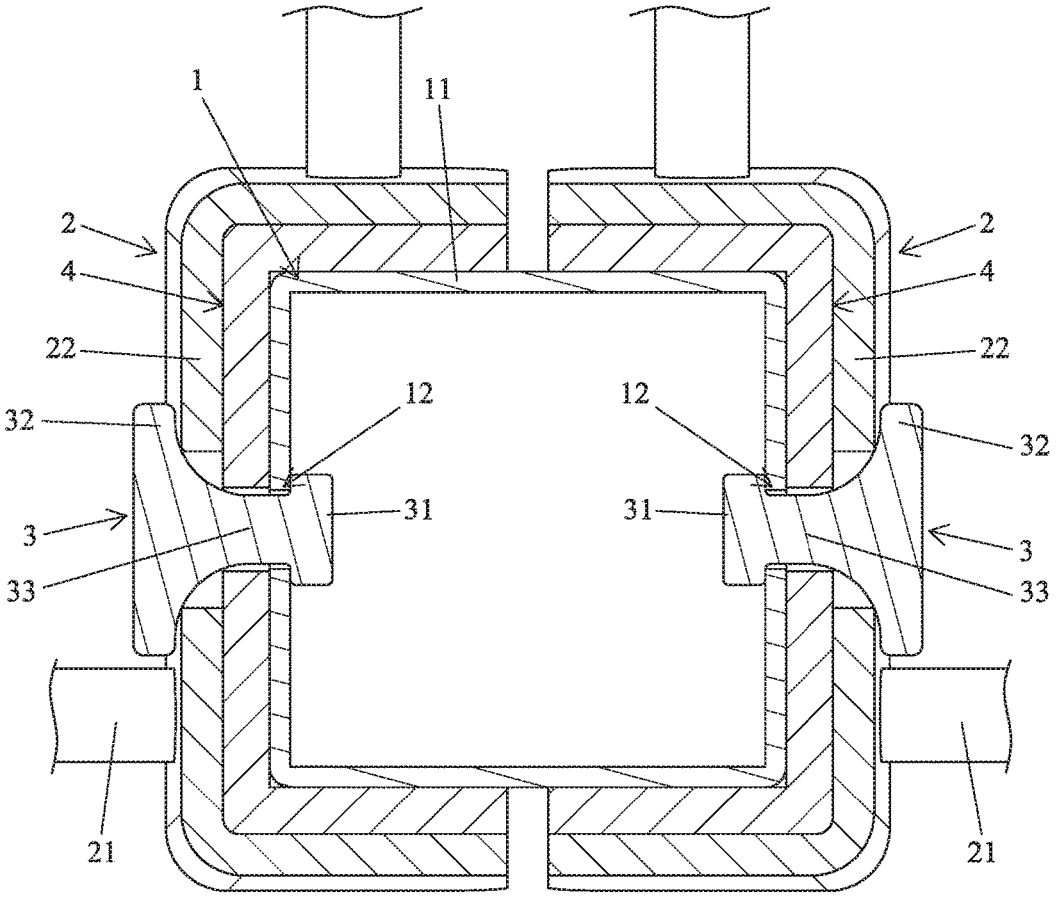
FIG. 10 is a partial, top, cross sectional view of the shelf assembly of FIG. 9.

More vertical posts 1 and more decks 2 can be added to construct a shelf assembly shown in FIGS. 9 and 10 or a shelf assembly of a different size. Thus, the overall quality of the shelf assembly is improved, and articles can be placed on the decks 2 conveniently. Furthermore, each vertical post 1 can have triangular cross sections or other polygonal cross sections to provide different combinations.

When it is desired to remove, for example, the bottommost deck 2, the bottommost deck 2 and the respective coupling members 3 can be removed without detaching the deck 2 above it, providing easier replacement. Furthermore, a lower deck 2 can be mounted without detaching an upper deck 2 to permit easier installation. In a case that any lining board 4 becomes brittle after a period of time of use, the respective deck 2 can still be supported by the respective coupling member 3, significantly improving safety and reliability.

Figure 11:
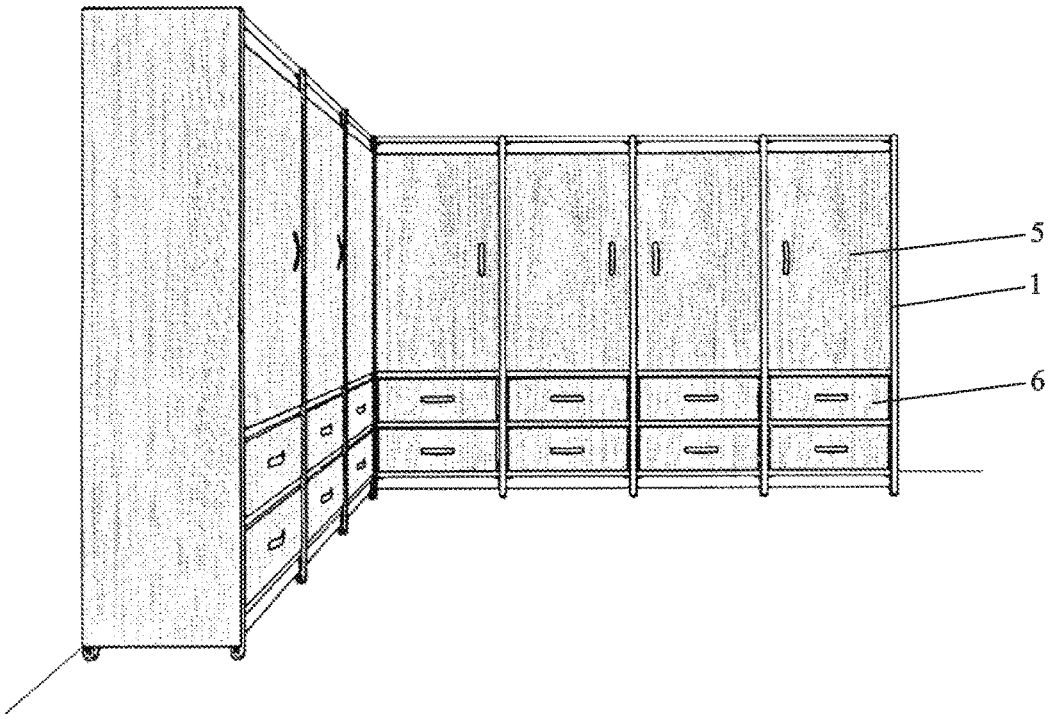
FIG. 11 is a perspective view of a cabinet constructed by the combination of the second example according to the present invention.

With reference to FIG. 11, panels 5 and drawers 6 can be added to a shelf assembly constructed according to the desired pattern, forming a larger cabinet and providing more combinations.

Figure 12:
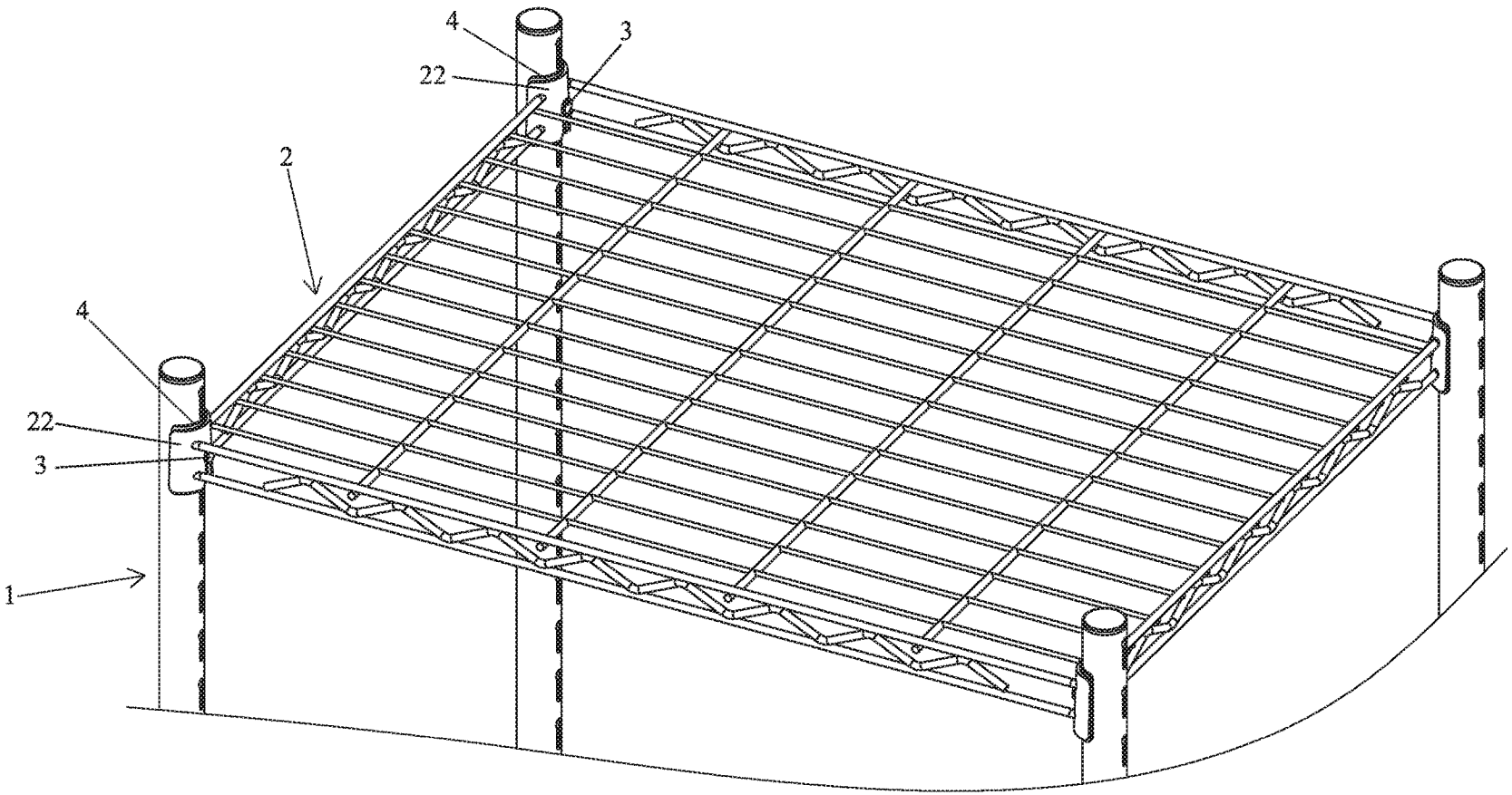
FIG. 12 is a perspective view of a shelf assembly of a third example according to the present invention.
Figure 13:
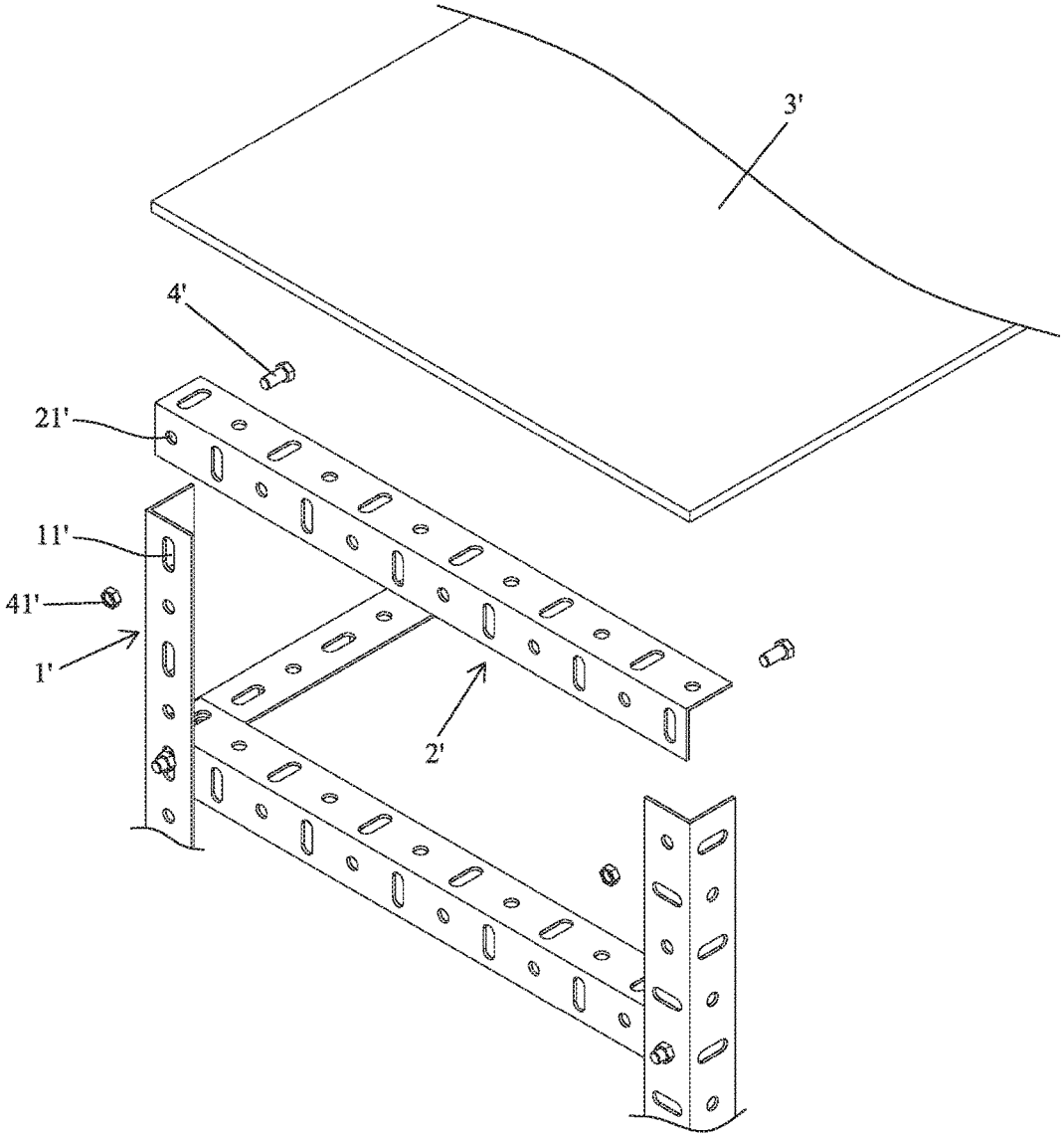
PRIOR ART F I G . 13
FIG. 13 is a partial, perspective view of a conventional shelf assembly.
Figure 14:
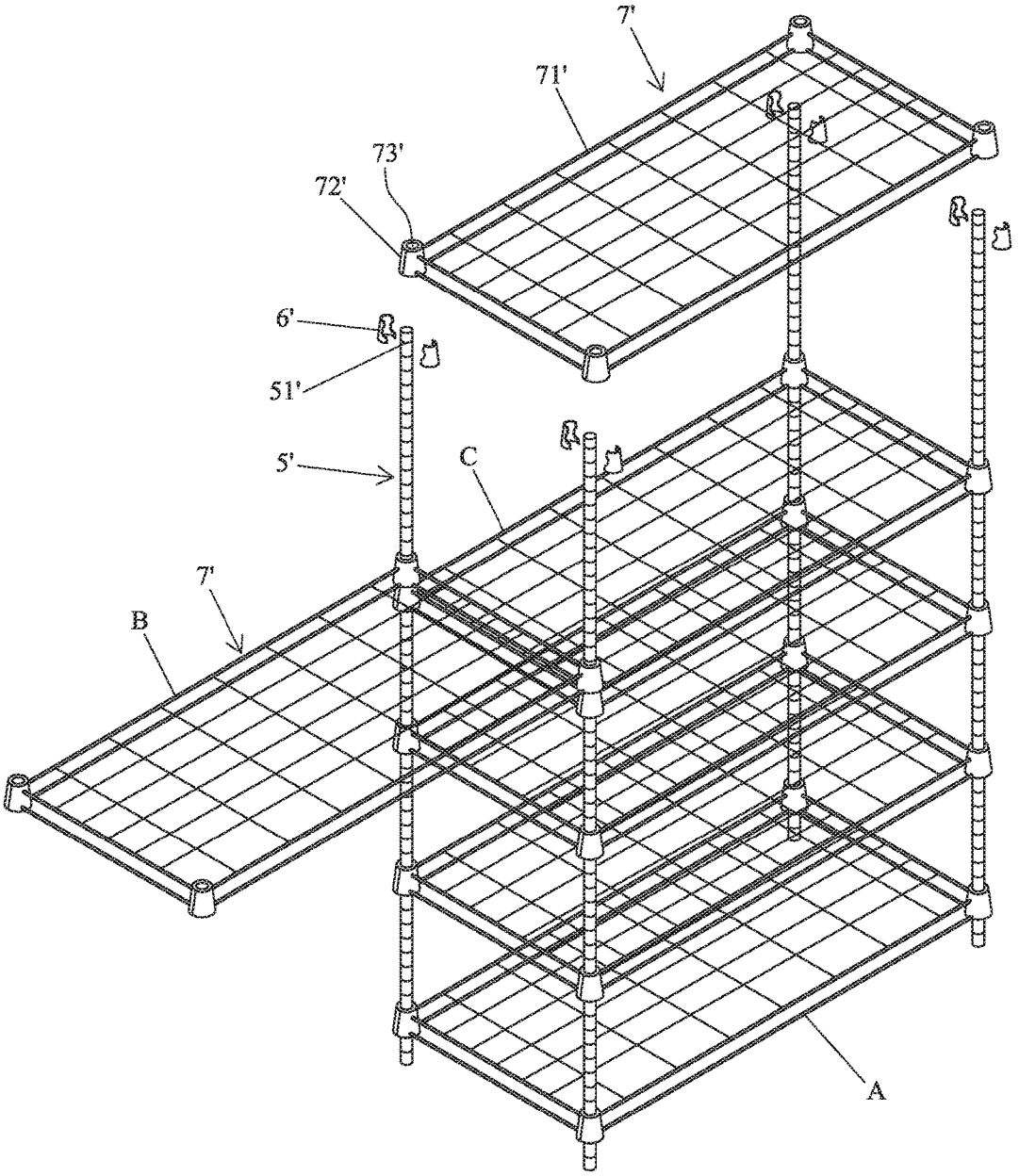
PRIOR ART F I G . 14
FIG. 14 is a perspective view of another conventional shelf assembly.
Figure 15:
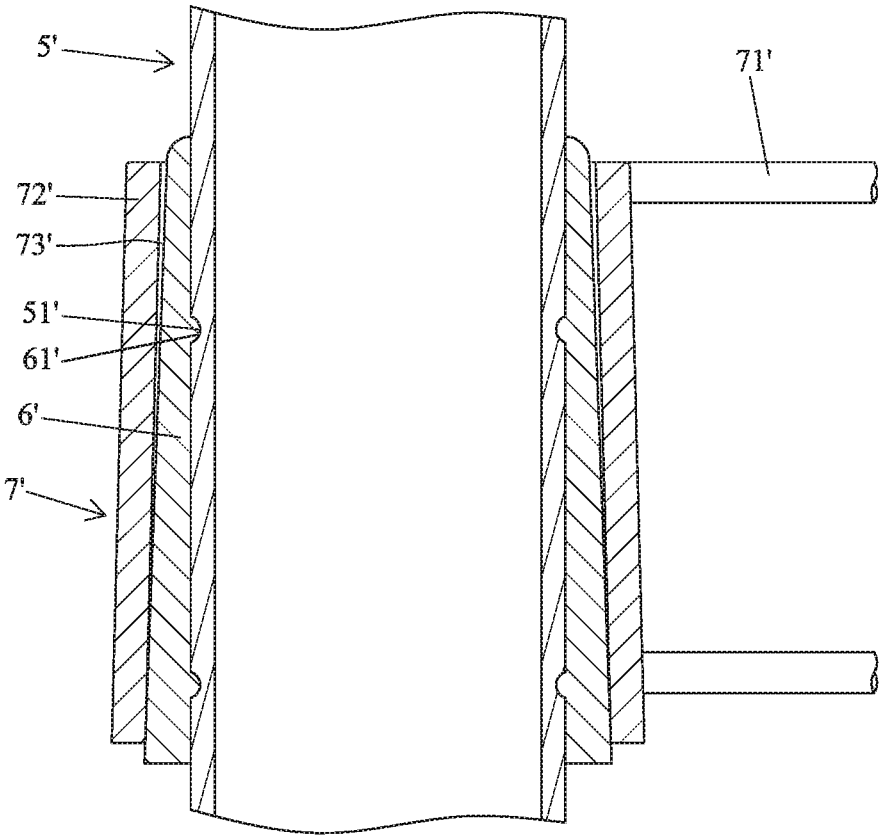
PRIOR ART F I G . 15
FIG. 15 is an enlarged, cross sectional view of a portion of the conventional shelf assembly of FIG. 14.

FIG. 12 shows a shelf assembly of a third example according to the present invention which is substantially the same as the second example except that each vertical post 1 has circular cross sections, each lining board 4 is arcuate, and each coupling board 22 is arcuate. Coupling members 3 can be used to assemble these components to provide enhanced assembling stability. Nevertheless, the vertical posts 1 can have other cross sections.

In view of the foregoing, the shelf assembly according to the present invention can be assembled with ease while providing enhanced assembling stability as well as easier replacement.

Although specific embodiments have been illustrated and described, numerous modifications and variations are still possible without departing from the scope of the invention. The scope of the invention is limited by the accompanying claims.

The invention claimed is:

1. A post and deck combination for a shelf assembly, comprising:

a vertical post, wherein the vertical post is hollow and includes an outer wall, wherein a plurality of slots is disposed at different heights of the outer wall, wherein each of the plurality of slots has a positioning portion;

a deck, wherein the deck is disposed parallel to a ground, wherein a coupling board is disposed on an edge of the deck and includes a first insertion groove having a first receiving end; and a coupling member, wherein the coupling member is columnar and includes a first end, a second end, and a columnar portion interconnected between the first end and the second end, wherein the columnar portion includes a first section adjacent to the first end and a second section adjacent to the second end, wherein a diameter of the first section is smaller than a width of each positioning portion of the vertical post, wherein the second section is interconnected to the first section and has a diameter to be received in the first receiving end of the first insertion groove, wherein the columnar portion has decreasing diameters from the second end toward the first section, wherein the second section includes an inclined guiding face, wherein the coupling member is configured to extend through one of the plurality of slots to couple with the vertical post, wherein the positioning portion of the one of the plurality of slots is located at the first section of the coupling member, wherein the first insertion groove of the coupling board is coupled with the first end of the coupling member, wherein the first receiving end is located on the inclined guiding face of the second section, and wherein the coupling board is movable toward the first section.

2. The post and deck combination for the shelf assembly as claimed in claim 1, wherein each of the plurality of slots includes an insertion portion at an upper end thereof, wherein the positioning portion is located below the insertion portion, wherein the width of the positioning portion is smaller than a width of the insertion portion, wherein the first end of the coupling member includes a first stopper face extending radially outward from the columnar portion, wherein a diameter of the first end of the coupling member is smaller than the width of each insertion portion and is larger than the width of each positioning portion, wherein the second end of the coupling member includes a second stopper face extending radially outward from the columnar portion, wherein a diameter of the second end of the coupling member is larger than a width of the first receiving end of the coupling board, and wherein a spacing between the first stopper face and the second stopper face is larger than a sum of a thickness of the outer wall of the vertical post and a thickness of the coupling board of the deck after assembly.

3. The post and deck combination for the shelf assembly as claimed in claim 1, further comprising a lining board made of a material softer than the vertical post and the coupling board, wherein the lining board includes a second insertion groove having a second receiving end, wherein the lining board is configured to couple with the coupling member by the second insertion groove, wherein the second receiving end is located at the first section of the coupling member, and wherein the lining board is disposed between the outer wall of the vertical post and the coupling board of the deck.

4. The post and deck combination for the shelf assembly as claimed in claim 3, wherein the vertical post has square cross sections, wherein the outer wall includes a first side having the plurality of slots, wherein the outer wall further includes second and third sides opposite to each other and extending perpendicularly to the first side, wherein the lining board includes a fourth side, a fifth side, and a sixth side respectively abutting against the first side, the second side, and the third side of the vertical post, wherein the second insertion groove is disposed on the fourth side, wherein the coupling board of the deck includes a seventh side, an eighth side, and a ninth side respectively abutting against the fourth side, the fifth side, and the sixth side, and wherein the first insertion groove is disposed in the seventh side.

5. The post and deck combination for the shelf assembly as claimed in claim 1, wherein the plurality of slots is disposed in two sides of the vertical post spaced from each other by 180° and are located at corresponding heights.

6. The post and deck combination for the shelf assembly as claimed in claim 1, wherein the first insertion groove of the deck extends upward from a bottom of the coupling board, wherein the first insertion groove includes a first opening at a lower end thereof and the first receiving end in a top end thereof, and wherein a width of the first opening is larger than a width of the first receiving end.

7. The post and deck combination for the shelf assembly as claimed in claim 3, wherein the second insertion groove extends upward from a bottom of the lining board, wherein the second insertion groove includes a second opening at a lower end thereof and the second receiving end in a top end thereof, and wherein a width of the second opening is larger than a width of the second receiving end.

8. The post and deck combination for the shelf assembly as claimed in claim 3, wherein the lining board includes an inner side having an inclined coupling face inclining outwardly and downwardly from a top end of the inner side toward a bottom end of the inner side of the lining board.

9. The post and deck combination for the shelf assembly as claimed in claim 3, wherein the lining board includes a protrusion located above the second insertion groove, and wherein the protrusion is configured to be inserted into one of the plurality of slots of the vertical post and to engage with a peripheral edge of the one of the plurality of slots.

10. A shelf assembly comprising:

four vertical posts disposed in four corners of a rectangular area, wherein each of the four vertical posts is hollow and includes an outer wall having a plurality of engaging slots disposed at different heights of the outer wall, and wherein each of the plurality of slots has a positioning portion;

a plurality of decks disposed parallel to a ground, wherein each of the plurality of decks includes four corners, wherein each of the four corners of each of the plurality of decks includes a coupling board, wherein each coupling board includes a first insertion groove having a first receiving end; and a plurality of coupling members, wherein each of the plurality of coupling members is columnar and includes a first end, a second end, and a columnar portion interconnected between the first end and the second end, wherein the columnar portion includes a first section adjacent to the first end and a second section adjacent to the second end and interconnected to the first section, wherein a diameter of the first section is smaller than a width of each positioning portion, wherein the columnar portion has decreasing diameters from the second end toward the first section, wherein the second section includes an inclined guiding face, wherein the second section of each of the plurality of coupling members has a diameter to be received in the first receiving end of the first insertion groove of a respective coupling board, wherein the first end of each of the plurality of coupling members is configured to extend through one of the plurality of slots of a respective one of the four vertical posts to couple with the respective one of the four vertical posts, wherein the positioning portion of the one of the plurality of slots is located at the first section of the coupling member, wherein the first insertion groove of each coupling board is coupled with a respective one of the plurality of coupling members, wherein the first receiving end of each coupling board is located on the inclined guiding face of the second section of the respective one of the plurality of coupling members, and wherein each coupling board is movable toward the first section of the respective one of the plurality of coupling members.

11. The shelf assembly as claimed in claim 10, wherein each of the plurality of slots includes an insertion portion at an upper end thereof, wherein the positioning portion is located below the insertion portion, wherein the width of the positioning portion is smaller than a width of the insertion portion, wherein the first end of each of the plurality of coupling members includes a first stopper face extending radially outward from the columnar portion, wherein a diameter of the first end of each of the plurality of coupling members is smaller than the width of each insertion portion and is larger than the width of each positioning portion, wherein the second end of each of the plurality of coupling members includes a second stopper face extending radially outward from the columnar portion, wherein a diameter of the second end of each of the plurality of coupling members is larger than a width of the first receiving end of each four coupling board, and wherein a spacing between the first stopper face and the second stopper face of each of the plurality of coupling members is larger than a sum of a thickness of the outer wall of the respective one of the four vertical posts and a thickness of the respective coupling board after assembly.

12. The shelf assembly as claimed in claim 10, further comprising a plurality of lining boards made of a material softer than the four vertical posts and the coupling boards, wherein each of the plurality of lining boards includes a second insertion groove having a second receiving end, wherein each of the plurality of lining boards is configured to couple with the respective one of the plurality of coupling members by the second insertion groove, wherein the second receiving end is located at the first section of the respective one of the plurality of coupling members, and wherein each of the plurality of lining boards is disposed between the outer wall of the respective one of the four vertical posts and a respective coupling board.

13. The shelf assembly as claimed in claim 12, wherein each of the four vertical posts has square cross sections, wherein the outer wall of each of the four vertical posts includes a first side having the plurality of slots, wherein the outer wall of each of the four vertical posts further includes second and third sides opposite to each other and extending perpendicularly to the first side, wherein each of the plurality of lining boards includes a fourth side, a fifth side, and a sixth side respectively abutting against the first side, the second side, and the third side of the respective one of the four vertical posts, wherein the second insertion groove is disposed on the fourth side, wherein each coupling board includes a seventh side, an eighth side, and a ninth side respectively abutting against the fourth side, the fifth side, and the sixth side of a respective one of the plurality of lining boards, and wherein the first insertion groove is disposed in the seventh side.

14. The shelf assembly as claimed in claim 10, wherein the plurality of slots of each of the four vertical posts is disposed in two sides of the vertical post spaced from each other by 180° and is located at corresponding heights.

15. The shelf assembly as claimed in claim 10, wherein each first insertion groove extends upward from a bottom of the respective coupling board, wherein each first insertion groove includes a first opening at a lower end thereof and the first receiving end in a top end thereof, and wherein a width of the first opening is larger than a width of the first receiving end.

16. The shelf assembly as claimed in claim 12, wherein each second insertion groove extends upward from a bottom of a respective one of the plurality of lining boards, wherein the second insertion groove includes a second opening at a lower end thereof and the second receiving end in a top end thereof, and wherein a width of the second opening is larger than a width of the second receiving end.

17. The shelf assembly as claimed in claim 12, wherein each of the plurality of lining boards includes an inner side having an inclined coupling face inclining outwardly and downwardly from a top end of the inner side toward a bottom end of the inner side of the lining board.

18. The shelf assembly as claimed in claim 12, wherein each of the plurality of lining boards includes a protrusion located above the second insertion groove, and wherein the protrusion is configured to be inserted into one of the plurality of slots of the respective one of the four vertical posts and to engage with a peripheral edge of the one of the plurality of slots.

* * * * *